US009221293B2

(12) United States Patent
Pesala et al.

(10) Patent No.: US 9,221,293 B2
(45) Date of Patent: Dec. 29, 2015

(54) METHOD TO DESIGN A SECURITY FEATURE ON THE SUBSTRATE OF SECURITY DOCUMENTS USING SUB WAVELENGTH GRATING

(71) Applicant: Council of Scientific & Industrial Research, New Delhi (IN)

(72) Inventors: Bala Pesala, Chennai (IN); Mridula Madhusudan, Rajasthan (IN)

(73) Assignee: Council of Scientific & Industrial Research, New Delhi (IN)

( * ) Notice: Subject to any disclaimer, the term of this patent is extended or adjusted under 35 U.S.C. 154(b) by 104 days.

(21) Appl. No.: 14/062,577

(22) Filed: Oct. 24, 2013

(65) Prior Publication Data

US 2015/0113793 A1 Apr. 30, 2015

(51) Int. Cl.

| | |
|---|---|
| ***B41M 3/14*** | (2006.01) |
| ***B44F 1/12*** | (2006.01) |
| ***B42D 25/328*** | (2014.01) |
| ***B42D 25/41*** | (2014.01) |
| ***B42D 25/36*** | (2014.01) |
| ***B42D 25/355*** | (2014.01) |

(52) U.S. Cl.

CPC ..... *B42D 25/328* (2014.10); *B42D 25/355* (2014.10); *B42D 25/36* (2014.10); *B42D 25/41* (2014.10); *Y10T 29/49* (2015.01)

(58) Field of Classification Search

CPC .... C09C 1/0015; C09C 1/04; C09C 2210/30; C09C 2210/40; G02B 5/1809

USPC ..... 427/7

See application file for complete search history.

(56) References Cited

U.S. PATENT DOCUMENTS

| | | | | |
|---|---|---|---|---|
| 4,980,569 | A | 12/1990 | Crane et al. | |
| 5,151,607 | A | 9/1992 | Crane et al. | |
| 2006/0127829 | A1 * | 6/2006 | Deng et al. | 431/188 |
| 2006/0285184 | A1 | 12/2006 | Phillips et al. | |
| 2007/0285782 | A1 * | 12/2007 | Stuck et al. | 359/569 |
| 2007/0292636 | A1 | 12/2007 | Phillips et al. | |
| 2009/0257126 | A1 * | 10/2009 | Walter et al. | 359/568 |

FOREIGN PATENT DOCUMENTS

| | | | |
|---|---|---|---|
| WO | WO 2011/116425 | A1 | 9/2011 |
| WO | WO 2012/019226 | A1 | 2/2012 |

* cited by examiner

*Primary Examiner* — Kelly M Gambetta

(74) *Attorney, Agent, or Firm* — Knobbe, Martens Olson & Bear, LLP

(57) ABSTRACT

Method of designing a security thread in security documents with better color contrast at any viewing angle is claimed. The invention discloses designing of security thread in security documents like bank notes using subwavelength gratings with period and thickness less than the wavelength of light. The sub wavelength gratings preferably asymmetric are designed such that the $O^{th}$ order reflections are of longer wavelength (red) and the higher order reflections (diffracted orders) are of shorter wavelengths (blue/green). The security thread so designed gives better color contrast unlike the rainbow colors of prior art thus allowing better and easier distinction of authentic documents.

19 Claims, 11 Drawing Sheets

METHOD TO DESIGN A SECURITY FEATURE ON THE SUBSTRATE OF SECURITY DOCUMENTS USING SUB WAVELENGTH GRATING

TECHNICAL FIELD OF INVENTION

The present invention relates to a method to design a security feature on the substrate of security documents using sub wavelength grating. More particularly, the present invention deals with a novel design for security threads in banknotes for identification of counterfeit notes through visual inspection. The design proposed in the invention provides better color contrast and different color effects when viewed from different sides without requirement of any specialized device for authentication of the document being verified. Security documents includes banknotes, currency notes, coin, credit card, check, passport, identity card, security and share certificate, driver's license, deeds of title, and travel document such as airline and train ticket, entrance card and ticket, birth, death and marriage certificate, and academic transcript.

BACKGROUND AND PRIOR ART

Even with the development of electronic banking and credit cards the society still relies on cash based transactions. The risk of fake or counterfeit currency is high in such a society. Even state of the art security features have been forged. The advantage that a counterfeiter has is that he does not need to produce the exact replica of the notes but just needs to produce a simulation that is good enough to pass at least one transaction. This problem is most significant and apparent in businesses handling a large volume of paper money transfers. Environments such as casinos, currency exchanges, banks, etc., require a more automated and reliable way of preventing and detecting counterfeit currency introduction.

The best defense against forgery would be to equip the general public to distinguish a fake note from a legitimate one. The authenticity of the note has to be ensured by the receiver after proper inspection which would not need sophisticated technologies. This would prove to be one of the most efficient ways to fight forgery.

One commonly employed and easily recognizable feature is a printed image, for example in the form of a portrait of a famous person. Traditionally, such images were applied to banknotes by techniques such as intaglio printing, often including a guilloche (fine line) pattern. The result was an image having a characteristic appearance and tactile impression which, at the time, was difficult for counterfeiters to reproduce.

U.S. Pat. No. 4,980,569 discloses a verification device comprising of two optical light source/detector pairs disposed on opposite sides of a proffered currency. The source and detector pairs are arranged for transmission and reception of optical energy through the currency if the thread is not present. Also, the source and detector pairs can determine the presence of a counterfeit thread on the currency surface by checking for light reflected off the currency surface. Thus, the '569 patent provides a twofold test wherein the thread, to be genuine, must be detected under transmitted light and not be detected under reflected light. However, the device in the '569 patent may give a false indication of the authenticity of a counterfeit currency when a pencil line is drawn on the currency surface at the normal thread location.

Further U.S. Pat. No. 5,151,607 discloses a verification device comprising the optical means of the '569 patent in combination with a magnetic detector. magnetic reader, or non-ferrous metal detector. The latter detectors determine the presence of the security thread, while the optical means determines whether the thread is properly within the currency or improperly disposed on either surface. However, no known device which effectively verifies the presence and authenticity of the aforementioned "solid" security thread has been provided.

Another way may to protect high-security documents against forgery would be putting a security thread through the documents. A security thread generally consists of a thin ribbon which runs through the document. Some security threads have engravings in them (for example, the denomination of the banknote). The threads can be completely invisible or they can appear to weave in and out of the paper. Threads can also be integrated with other security features like micro-printing or fluorescence to provide additional security. Along with the security threads are also involved methods of its verification.

Many security threads have the ability to change color when viewed at different angles. Some threads use color shifting inks or flakes to create these effects using interference stacks or liquid crystal technology. More secure authentication features can be produced by employing optically variable structures, such as diffraction gratings, which change in appearance as the observer changes their angle of view relative to the structure. However, conventional "gratings" produce undesirable "RAINBOW" effect referring to variety of colors produced simultaneously thus limiting their applicability.

W02012019226 discloses a method wherein the device has slots that are separated by non-conductive regions and overlapped in dielectric material. Zero order diffraction network elements are modulated in a region in a manner that colored image is visible for a person viewing the device. The person viewing the device observes variable optical effect when the device is pivoted around an axis perpendicular to a plane. The person viewing the device observes another variable optical effect when the device is located under the polarized light and pivoted around another axis perpendicular or parallel to the plane. However the method described above doesn't provide ways to attain a large color contrast using gratings and methods to eliminate the rainbow effects produced by the diffraction grating.

W02011116425 discloses a security document comprising a substrate provided with an integral security device formed on the substrate, wherein the security device comprises an image layer and a focusing layer, the image layer including a plurality of embossed relief formations in a first radiation curable ink layer on a first surface of the document, the focusing layer including a plurality of embossed focusing element relief formations in a second radiation curable ink layer on a second surface, wherein the total thickness of the document falls substantially within the range from 60 to 140μ and said first and second surfaces are separated by a predetermined distance greater than 50μ to produce a visible optical effect when viewing the image layer through the focusing layer. However, the realization of the structure mentioned above requires extensive fabrication steps especially when one considers the use of subwavelength diffractive elements. Further, no design methodology has been presented as to how to optimize the diffractive element in order to achieve the desired color contrast.

To overcome the problems of the prior art as briefly mentioned above, inventors have come up with the current invention which by-passes the need of exhaustive verification devices and predicting the authenticity of currency notes with naked eyes.

The objective of the current invention is to design a security feature that provides an easily distinguishable color contrast (red/green or red/blue) using novel high index contrast subwavelength gratings. This method gives the advantage of higher and easily customizable color contrast to better distinguish between a fake and an authentic banknote which would appear red when viewed normally and blue/green when viewed at glancing angles. The use of asymmetric gratings can provide an additional visual effect: the security thread appears in a different color when viewed at glancing angle from different sides. Polarization effects can also be incorporated using high-contrast grating technology to provide additional security. The mechanism proposed here requires specific variables which make it resource intensive and hence is not easily replicable by the counterfeiters, making it relatively "copy-proof".

The usage of the method is not restricted to currency notes but may also be used in identity card, passport, credit card, check, driving license, security certificate, train ticket, flight ticket, share certificate, entrance ticket, birth certificate, marriage certificate, death certificate and transcript etc to ensure authenticity.

Also the high-contrast grating disclosed here finds various applications in the field of optoelectronic devices and components such as broadband/narrowband reflectors, high-Q filters and resonators, multi-wavelength/tunable lasers, low-loss hollow core waveguides, light concentrators etc.

OBJECTIVES OF THE INVENTION

The main objective of the present invention is to design a security feature that can be incorporated on the substrate of security documents like banknotes using high index contrast subwavelength grating, which overcomes the drawback of the hitherto known prior art as detailed above.

Another objective of the present invention is to utilize diffraction properties of subwavelength gratings.

Yet another objective of the present invention is to design subwavelength gratings, with period less than the wavelength of light, and customizing duty cycle such that the grating can reflect longer wavelengths such as red at normal incidence and diffract shorter wavelengths such as blue or green at glancing angles.

Yet another objective of the present invention is to utilize the high index contrast between the grating and the grating substrate material to increase the color contrast.

Still another object of the invention is to control the reflectivity of the grating in such a way that the $O^{th}$ order reflections are of longer wavelength (red) and the higher order reflections (diffracted orders) are of shorter wavelengths (blue/green).

Yet another object of the invention is to design the subwavelength such that the reflection efficiency is above 80% for $0^{th}$ order reflections of longer wavelengths and above 30% for diffraction of shorter wavelengths.

Yet another object of the invention is to utilize asymmetric structure for the high-contrast grating which would provide asymmetric higher order diffractions to realize different visual effects on inspection from different sides.

Still another objective of the invention is to provide subwavelength grating design which is applicable for 2D gratings also.

Yet another objective of the invention is to provide subwavelength grating design which may include the polarization effect.

Still another objective of the invention is to enable security feature preferably in form of a thread, in security documents including banknotes, currency notes, coin, credit card, check, passport, identity card, security and share certificate, driver's license, deeds of title, and travel document such as airline and train ticket, entrance card and ticket, birth. death and marriage certificate, and academic transcript.

Still another objective of the invention is to enable security feature preferably in form of a thread on "substrate" including paper or other fibrous material such as cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

In this invention the unique diffraction properties of subwavelength gratings are utilized to make a security thread which may be run through security document in question. The key idea used by the inventors is the fact that unlike normal gratings, subwavelength gratings do not cause diffraction of light if the wavelength of the light is larger than the period of the grating. The use of such diffraction optimized high-contrast subwavelength grating helps to give immediate and distinct color contrast to naked eyes of the observer. Inventors have used both symmetric and asymmetric gratings to observe the color contrast of the substrate. The security thread made as per the invention may include the polarization effect also. Further, inventors have utilized the high refractive index contrast between the grating ($n_{grating}$=2.5) and the grating substrate ($n_{substrate}$=1.5) and optimized the grating thickness and duty cycle (width of the grating w.r.t the period of the grating) to achieve reflection at desired angle and with desired color effects. The invention is exceptionally advantageous in terms that the color distinction is markedly visible with naked eyes. The reflective angles of the color are so tuned that any subjective errors in the observation are eliminated to minimum. Further the method to authenticate using such security thread eliminates requirement of any such specific external devices. Other parameter values of the grating will also be possible if one considers binary grating/gratings with other profiles such as rectangular, semi-circular circular gratings, polygons etc.

SUMMARY OF THE INVENTION

Accordingly, the present invention provides a method to design a security feature on the substrate of security documents like banknotes using sub wavelength grating comprising the steps of:

- Optimizing the high refractive index subwavelength gratings such that period and thickness of subwavelength gratings are designed to be smaller than the wavelength of incident light to be in the range of 0.3 μm-0.7 μm and 0.1 μm to 5 μm respectively, duty cycles of the subwavelength gratings are in range of $DC_1$ of 0.01-0.99 and $DC_2$ 0.01-0.99 so that $0^{th}$ order reflections are of longer wavelength (red) and the higher order reflections (diffracted orders) are of shorter wavelengths (blue/green).
- Integrating the subwavelength gratings on the desired surface of the substrate;
- Integrating this assembly of substrate and subwavelength grating to the surface of the security document by interweaving to get the color reflection of desired wavelength and contrast.

According to a preferred embodiment of the present invention the high refractive index subwavelength grating is preferably asymmetric.

According to another embodiment of the present invention, the security feature comprising sub-wavelength gratings of high index material made on a low-index grating substrate by any known methods like interference lithography, E-beam lithography, Focused Ion Beam lithography, Nano-imprint and micro-fabrication methods.

According to an embodiment of the invention, the high refractive index grating material can be preferably silicon derivatives (amorphous silicon/porous silicon or Nitrides (Gallium nitride, Aluminium nitride) or any other appropriately doped polymers) optimized to achieve a refractive index range of 1.5 to 5.

Yet another embodiment of the present invention, single layer subwavelength gratings where in the high refractive index grating is completely surrounded by a low refractive index material such as air, glass/inorganic materials or polymer materials.

Still another embodiment of the present invention, the difference in the refractive index of the subwavelength grating and the substrate is greater than or equal to 0.3 to 5 for better contrast.

Yet another object of the present invention, wherein the reflection efficiency of the subwavelength grating is above 80% for $0^{th}$ order reflections of longer wavelengths and above 30% for diffraction of shorter wavelengths.

Still another embodiment of the present invention, the subwavelength grating is selected from group consisting of rectangular, triangular and semi-circular profile projections, polygonal shapes.

Yet another embodiment of the present invention, other security features such as florescent markers/magnetic materials can also be incorporated optionally in the grating materials of the security thread.

Still another embodiment of the present invention, the designed security feature preferably in form of thread has polarization effect.

Still another embodiment of the invention "grating substrate/s" as used herein refers to $Si0_2$ or other suitable inorganic compounds to achieve the desired low refractive index, paper or other fibrous material such as cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

Surface of the security document on which the assembly of the high refractive index contrast grating and substrate is attached includes paper or other fibrous material such as cellulose; a plastic or polymeric material but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

Still another embodiment of the invention the security thread with sub-wavelength grating may be used to authenticate the "security documents" by color contrast like banknotes, currency notes, coin, credit card, check, passport, identity card, security and share certificate, driver's license, deeds of title, and travel document such as airline and train ticket, entrance card and ticket, birth, death and marriage certificate, and academic transcript

DETAILED DESCRIPTION OF INVENTION

In accordance with the objectives of the invention, is disclosed a novel approach for designing security features that can be incorporated on/in security documents in order to obtain desired visual effects with identifiable color contrast when viewed at different angles using high-contrast subwavelength gratings integrated on surface of suitable substrates. This assembly of subwavelength grating and substrate is attached to the surface of security document by interweaving.

Though gratings have been exemplified herein, it is obvious that the invention may be used in other formats known to a person skilled in the art.

GLOSSARY OF TERMS USED IN SPECIFICATION

1. Glancing viewing angle: Viewing the security thread at a tilted angle
2. Normal viewing angle: Viewing the security thread at a perpendicular direction to the plane of the substrate incorporating the security thread
3. Polarization: Means the orientation of oscillations in the plane perpendicular to a transverse wave's direction of travel. Polarization as herein referred is called Transverse Electric (TE) i.e. Electric field parallel to the grating groves and Transverse Magnetic (TM) i.e. Electric field perpendicular to the grating groves further referred in specification
4. Parameters of grating
   - Period (A): Distance between the two successive groves of the grating
   - Thickness ($t_g$): Thickness of the grating layer
   - Duty cycle (D.C.): Percentage of high index grating material in one period 5. Subwavelength Grating: Grating with dimensions less than the wavelength of light. Gratings are called High Contrast subwavelength Gratings (HCG) when there is a high refractive index contrast between the grating and the grating substrate/air.
6. Viewing angle: Direction in which the security thread is examined.

The object of the invention is to utilize the unique diffraction properties of subwavelength gratings to come up with a security feature in documents which may be identified with naked eyes as well. The fact that unlike normal gratings, subwavelength gratings do not cause diffraction of light, if the wavelength of the light is larger than the period of the grating has been used by the inventors to come up with the current invention.

Figure 1:
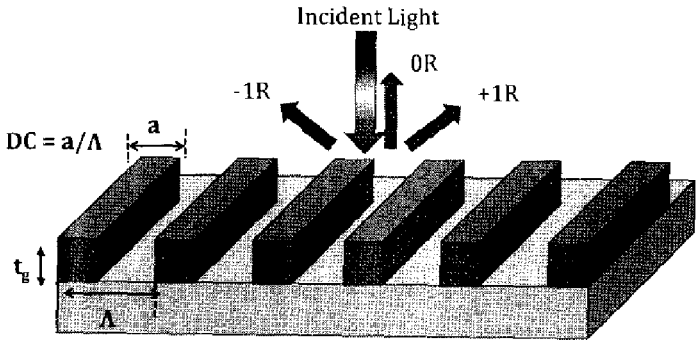
FIG. 1: Symmetric high-contrast grating structure on a substrate.

Using this key idea, inventors have designed optimized subwavelength gratings, with period less than the wavelength of light, which can reflect longer wavelengths such as red at normal incidence and diffract shorter wavelengths such as blue or green at glancing angles. High refractive index contrast between the grating and the substrate is essential to maximize this color contrast effect. Symmetric HCG's, as in FIG. 1, are single layer subwavelength gratings where in the high index grating is completely surrounded by a low index material.

The high index grating material as per the current invention can be silicon derivatives (amorphous silicon/porous silicon or Nitrides (Gallium nitride, Aluminium nitride) or any other appropriately doped polymers) optimized to achieve a refractive index of 1.5-5.

The low index material includes glass/inorganic or any other polymer materials with a refractive index of 1.1 to 3 in the visible wavelength region.

Further a person skilled in the art knows that there are 3 physical parameters that control the reflectivity of the grating: period (A), thickness ($t_g$) and duty cycle, defined as the percentage of high index material in a period. The inventors have optimally designed the subwavelength grating parameters (period, thickness and duty cycle) in such a way that the $O^{th}$ order reflections are of longer wavelength (red) and the higher order reflections (diffracted orders) are of shorter wavelengths (blue/green). The thickness and period are kept smaller than the wavelength of incident light.

Preferably the period of the grating is optimized to 0.3 μm-0.8 μm and thickness to 0.05 μm to 0.8 μm to obtain the desired color distinction.

The design of the security feature as per invention is characterized in providing distinct color differentiation from any viewing angle and also simultaneously eliminating the "RAINBOW EFFECT" problem of the prior art.

The optimized subwavelength gratings according to the invention can be fabricated on surface of low-index grating substrates mentioned above using interference lithography, E-beam lithography, Focused Ion Beam lithography, Nano-imprint and micro-fabrication methods and are inlaid on the substrate of the security document. When viewed by the observer from different angle it would give different color contrast. Presence of such color contrast will categorize the document as valid/secure or otherwise invalid/insecure.

Figure 2:
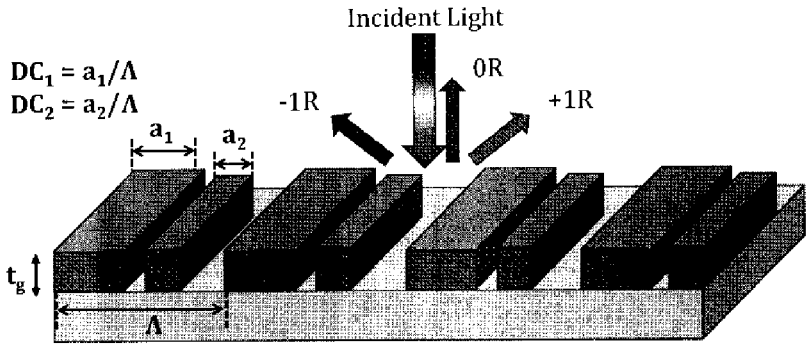
FIG. 2: Asymmetric high contrast grating structure on a substrate.

As in FIG. 2, the inventors have also explored the advantages of using asymmetric structure for the HCG which would provide asymmetric higher order diffractions. These higher order diffractions would lead to different visual effects on inspection from different sides (for example, using optimized grating design when viewed from left at glancing angles the color can appear as green but when viewed from right at glancing angles the color can appear as blue). The design can be easily extended for 2D gratings and also to include the polarization effects.

The decision for want of higher contrast or optionally more security markers may be relative to the importance of the document. Extremely sensitive documents may include other security features such as florescent markers/magnetic materials can also be incorporated in the grating materials also. The security feature designed as per the invention is preferably a security thread.

"Substrate/s" as used herein may be glass/paper or other fibrous material such as cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

Surface of the security document on which the assembly of the high refractive index contrast grating and substrate is attached includes cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

Security document as herein refers to banknotes, currency notes, coin, credit card, check, passport, identity card. security and share certificate, driver's license, deeds of title, and travel document such as airline and train ticket, entrance card and ticket, birth, death and marriage certificate, and academic transcript The foregoing description of embodiments of the present invention have been prepared for purposes of illustration and description. It is not intended to be exhaustive or to limit the present invention to precise form disclosed; modifications and variations are possible in light of the above teachings. The embodiments have been chosen to explain the principles of the present invention and should not be construed to be limitation in any form.

EXAMPLES

The following examples are given by way of illustration and therefore should not be construed to limit the scope of the present invention.

Example 1

An example of designing of security thread consists of the sub-wavelength diffraction grating with rectangular shape of thickness $t_g$=0.5 period A=0.5 μm and DC=0.5. The grating material comprising of Silicon derivatives having a refractive index of 3. The asymmetric (which may be symmetric also) subwavelength grating is integrated on top of the SiO, substrate with refractive index 1.5 using interference lithography as shown in FIG. I. This assembly of the substrate and high contrast index grating can be attached to the bank note by interweaving the security thread in the currency note. These optimized parameters enable high reflection efficiency for $O^{th}$ order reflections of longer wavelengths and high diffraction efficiency of shorter wavelengths giving distinct color differentiation.

Example 2

Symmetric grating design: Simulations were performed based on Rigorous Coupled Wave Analysis (RCWA) to find an optimized design wherein the longer wavelength light (red wavelengths) are reflected at normal incidence and shorter wavelengths (blue/green) are diffracted at glancing angles.

RCWA is a semi-analytical method in computational electromagnetic that is most typically applied to solve scattering from periodic dielectric structures. It is a Fourier-space method so devices and fields are represented as a sum of spatial harmonics and the scattered field amplitudes are obtained by matching the boundary conditions in electric and magnetic fields at each interface. From this reflection, transmission and diffraction efficiencies are calculated.

Figure 3:
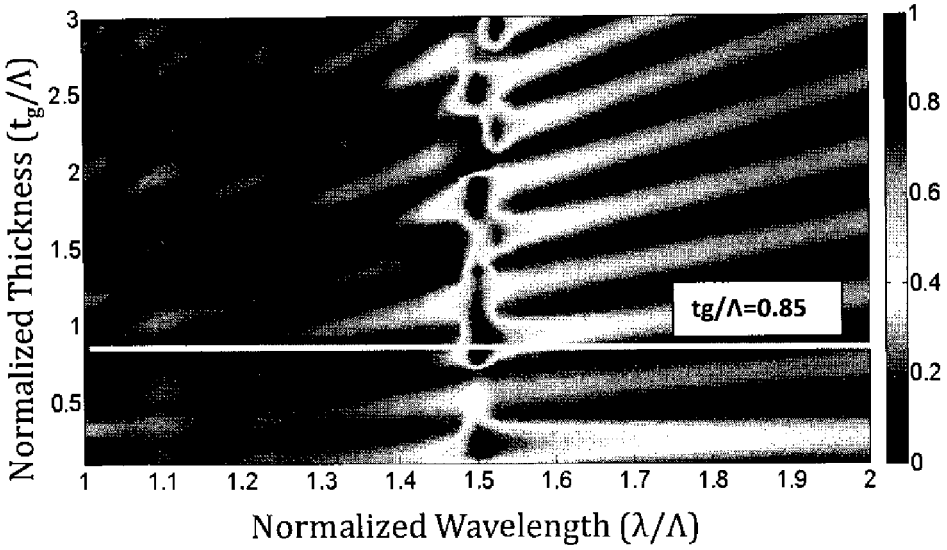
FIG. 3: Contour plot of reflected light intensity as a function of wavelength and the thickness $t_g$ of the grating for a duty cycle of 0.5.

FIG. 3 shows the contour plot of intensity of light reflected for a duty cycle DC of 0.5 and for various thickness values "$t_g$" of the grating for $0^{th}$ order reflection. Refractive index of the grating is assumed to be 2.5 and the substrate is 1.5 and the polarization of the incident light is assumed to TE (i.e. electric field parallel to the grating).

Figure 4:
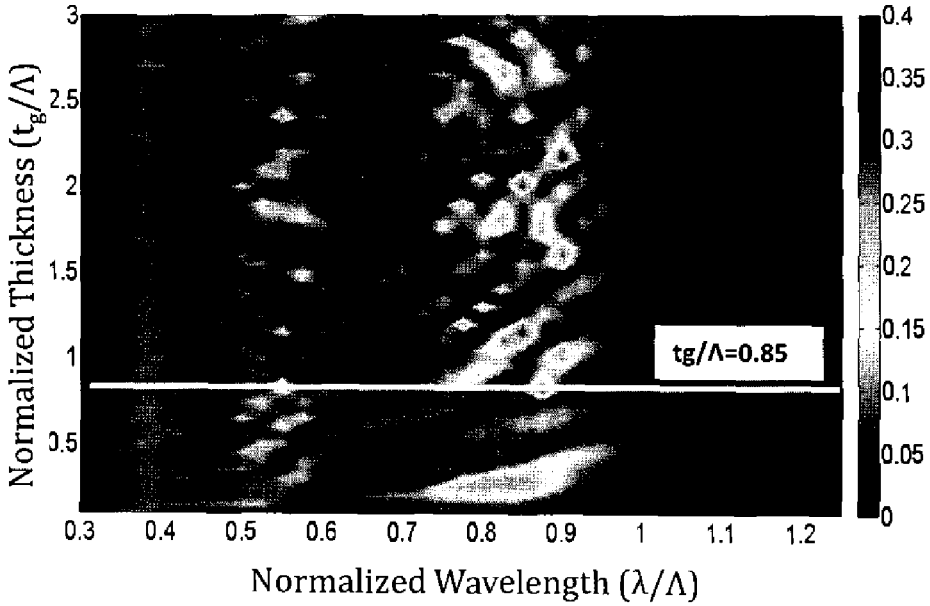
FIG. 4: Contour plot of diffracted light intensity as a function of wavelength and the thickness $t_g$ of the grating for a duty cycle of 0.5.

FIG. 4 shows the contour plot of diffracted intensity for the same grating parameters. The contour plot shows that it is possible to find an optimized design, $t_g/A=0.85$, wherein the reflection efficiency is above 80% for $O^{th}$ order reflections of longer wavelengths and above 30% for diffraction of shorter wavelengths. Future simulations will include polarization effects and two dimensional grating structures.

Figure 5:
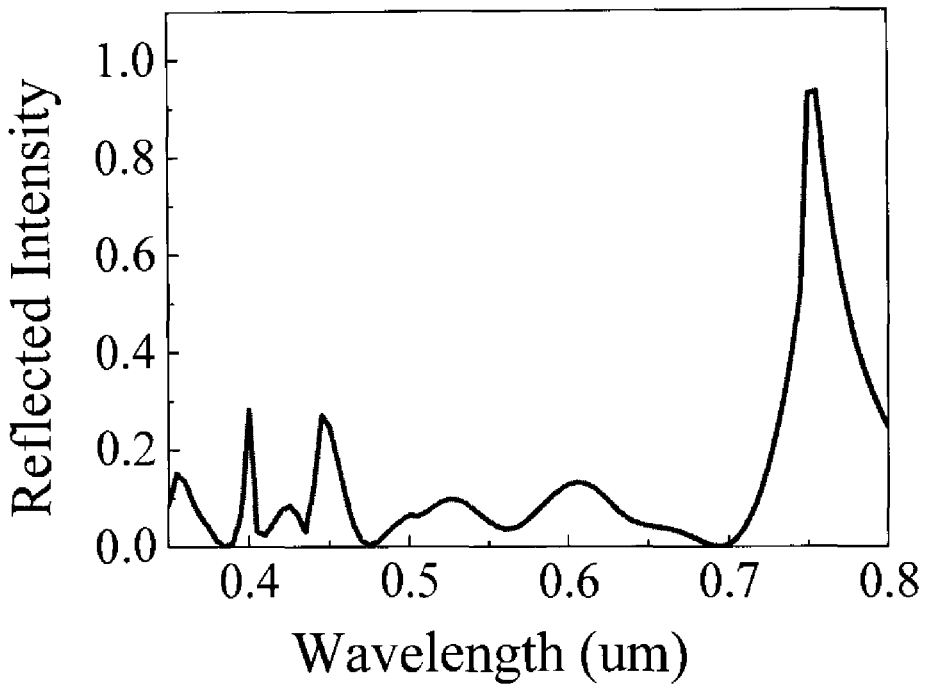
FIG. 5: Reflected light spectrum from an optimized symmetric grating as seen by the human eye at normal viewing angle
Figure 6:
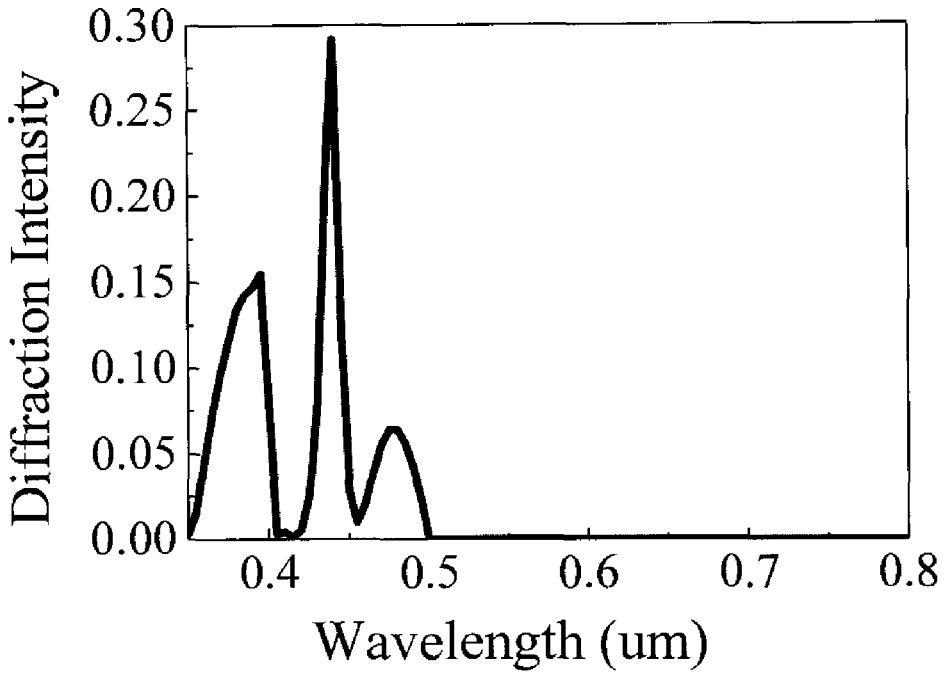
FIG. 6: Reflected light spectrum from an optimized symmetric grating as seen by the human eye at glancing angles

To find the exact reflectivity at various wavelengths we have chosen the period of the grating to be 0.5 um confirm. FIG. 5 shows the spectrum which will be perceived by the eye after reflection from the symmetric grating structure at normal viewing angle and FIG. 6 shows the spectrum of light which will be perceived by the eye at glancing angles.

To obtain the actual color perceived by the eye, one has to apply appropriate scaling factor to account for the eye sensitivity. The eye sensitivity curve gives the sensitivity of the human eye towards various colors in the visible spectrum. Hence, the actual color reflected from the grating as perceived by the human eye would be the convolution of the spectrum reflected by the grating, color matching functions and the spectrum of the illuminated source. Using this methodology, the color perceived by the eye at normal viewing angles corresponding to the reflection spectrum in FIG. 5 is obtained as pink while the color perceived by the eye at glancing angles corresponding the reflection spectrum in FIG. 6 is obtained as blue. This clearly demonstrates the viability of HCG's as color shifting tags.

Example 3

Asymmetric grating design: Simulations are performed based on RCWA to find an optimized design wherein the longer wavelength light (red wavelengths) are reflected at normal incidence and shorter wavelengths (blue/green) are diffracted at glancing angles.

Figure 7:
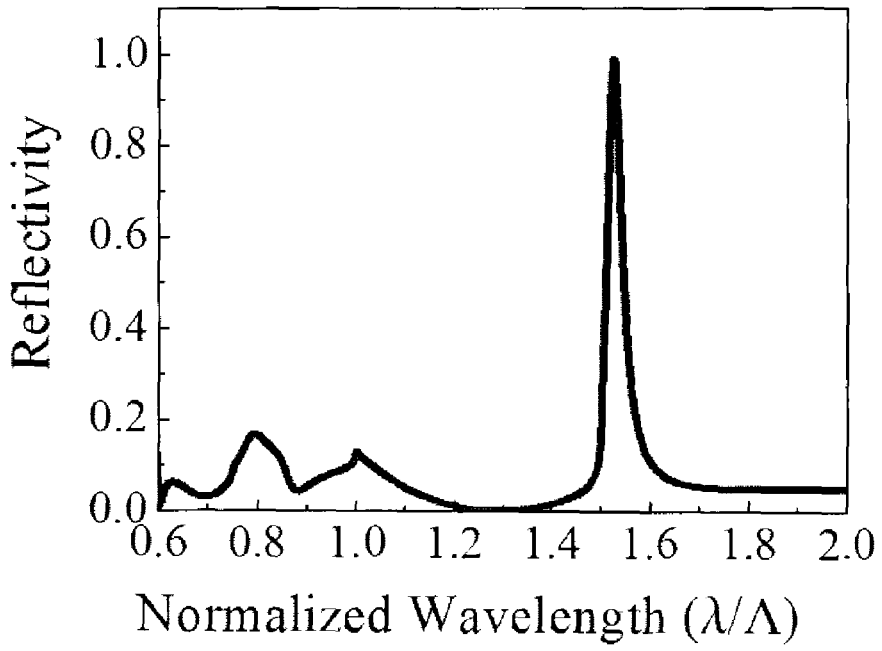
FIG. 7: Reflected light spectrum from an optimized asymmetric grating at normal viewing angle
Figure 8:
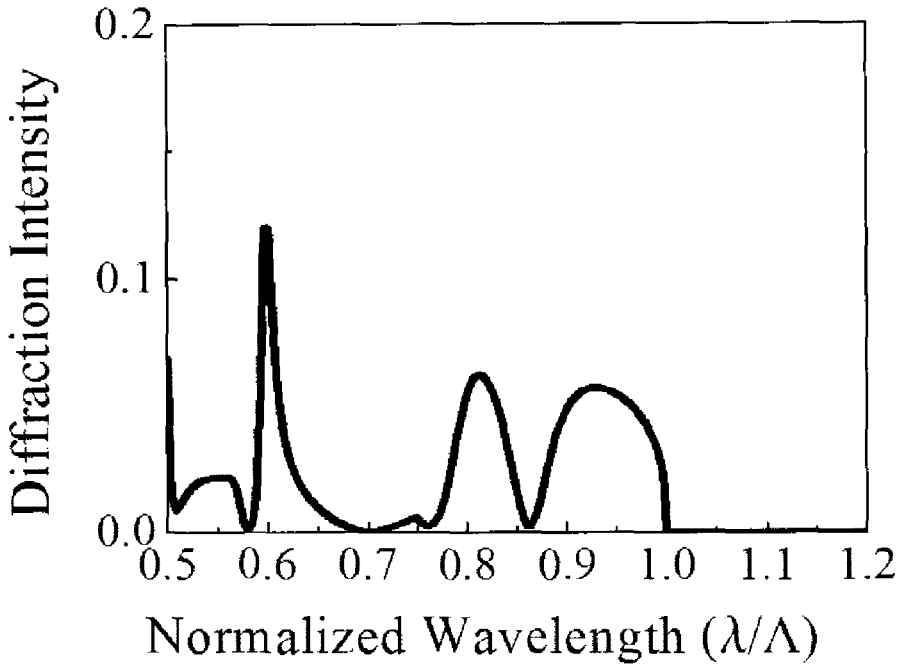
FIG. 8: Reflected light spectrum from an optimized asymmetric grating at glancing angles (for +1 diffraction orders)
Figure 9:
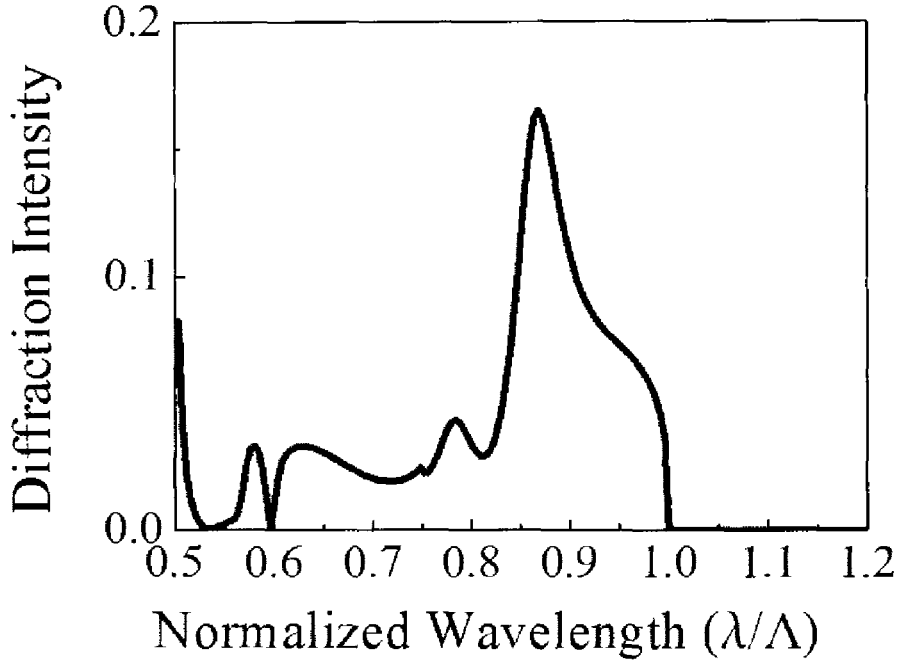
FIG. 9: Reflected light spectrum from an optimized asymmetric grating at glancing angles (for −1 diffraction orders)

This example shows the advantage of using asymmetric gratings to obtain additional visual effect so that the color perceived at glancing angles is different when viewed from the left or the right. The optimized grating structure has parameters $t_g/A=0.3$ and duty cycles $DC_1$ of 0.56 and $DC_2$ of 0.1 (FIG. 2). The polarization is assumed to be TM. FIG. 7 shows the spectrum of light which will be perceived by the eye after reflection from the asymmetric grating structure at normal viewing angle. FIGS. 8 and 9 show the reflected spectrum of light at glancing angles. The spectrum clearly shows that for minus and plus first order diffracted light, the spectrum perceived by eyes would be different. With further design optimization, it is possible to obtain a unique color effect such that the thread appears blue when viewed at glancing angle from one side while it appears green from the other side.

Example 4

Figure 10:
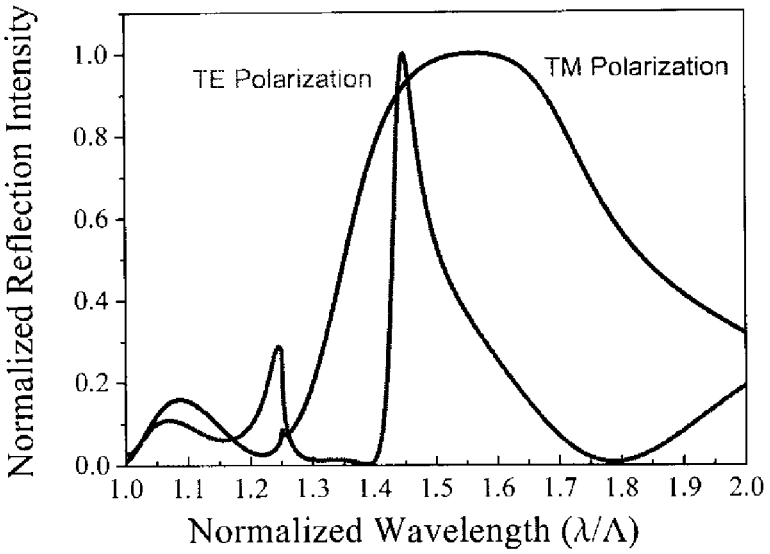
FIG. 10: Reflected intensity for TE and TM polarization demonstrating the polarization effect
Figure 11:
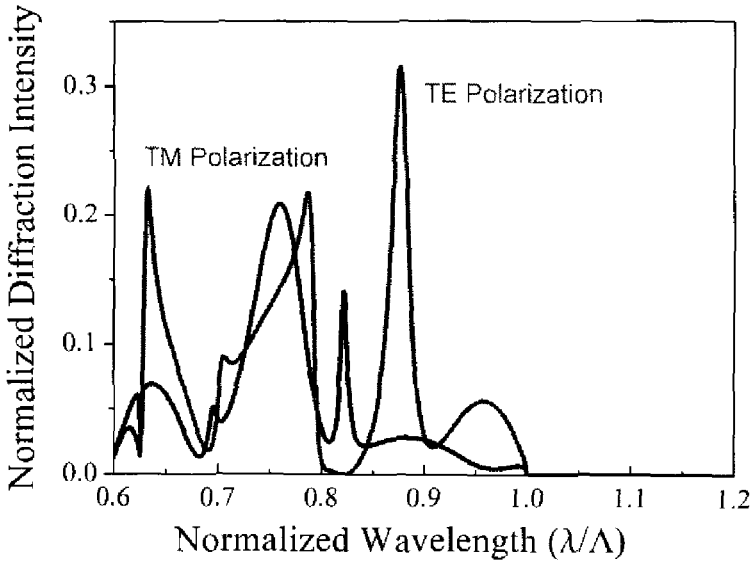
FIG. 11: Diffracted intensity for TE and TM polarization demonstrating the polarization effect

Polarization dependent visual effects: A 1D high-contrast grating naturally has polarization dependence since the physical effects vary depending on whether the electric field is parallel or perpendicular to the grating. This polarization dependence can be used to produce novel visual effects. FIGS. 10 and 11 shows the reflection and diffracted intensities for TE (electric field parallel to the grating) and TM polarization (electric field perpendicular to the grating). For TE polarization, sharp spectral features are observed which gives rise to angle-dependent color effects as discussed in the earlier two examples. However, for TM polarization, FIG. 9 show that these color effects mostly disappear. Hence, if one wears polarizing glasses or observe the bank note under polarized light, the observed color effects would be different as the note is rotated. In future, using 1D/2D gratings and by proper parameter optimization, different color effects at normal and glancing viewing angles can be obtained for different polarizations.

Advantages of the Invention

Security document with security feature of the invention as of the invention are easy to notice and distinguish the fake and authentic document by the color differentiation.

When asymmetric grating is used to design the security feature additional visual effect are observed so that the color perceived at glancing angles is different when viewed from the left or the right ensuring any missing of the signals.

The color distinction is quite clear eliminating any subjective errors

Does not require any additional devices for checking the authenticity of the document. Naked eyes are fine enough.

This reduces any space requirements/resource intensive equipment for checking the authenticity of the security document. This increases the wide areas where all the documents with security thread may be used.

We claim:

1. A method to design a security feature on a substrate of a security document using sub wavelength grating comprising:

optimizing high refractive index sub wavelength gratings on the substrate to eliminate rainbow effects, such that a period of the sub wavelength gratings is designed to be smaller than a wavelength of incident light in the range of 0.3 μm 0.7 μm, wherein a thickness of the sub wavelength gratings is in the range of 0.1 μm to 5 μm respectively, wherein at least two duty cycles of the sub wavelength gratings comprise a first duty cycle ($DC_1$) in a range of 0.01-0.99 and a second duty cycle ($DC_2$) in a range of 0.01-0.99, so that $O^{th}$ order reflections are of longer wavelength (red) and high intensity and the higher order reflections (diffracted orders) are of shorter wavelengths (blue/green) and high intensity;

integrating the sub wavelength gratings on a desired surface of the substrate to obtain an assembly of substrate and sub wavelength grating to the surface of the security document; and integrating the assembly of substrate and sub wavelength grating to the surface of the security document by interweaving to obtain a color reflection of desired wavelength and contrast.

2. The method as claimed in claim 1, wherein the high refractive index sub wavelength grating is asymmetric, leading to distinct color contrast when viewed from different sides.

3. The method as claimed in claim 1, wherein the difference in the high refractive index of the sub wavelength grating and the substrate is greater than or equal to 0.3 to 5 for better contrast.

4. The method as claimed in claim 1, wherein the high refractive index sub wavelength grating is completely surrounded by a low refractive index material.

5. The method as claimed in claim 1, wherein the high refractive index grating material is a silicon derivative, a nitride or any other appropriately doped polymer.

6. The method as claimed in claim 4, wherein the low refractive index material comprises air, glass/inorganic materials or a polymer material.

7. The method as claimed in claim 1, wherein the sub-wavelength gratings of high index material are fabricated on a low-index grating substrate by a method selected from the group consisting of interference lithography, E-beam lithography, Focused Ion Beam lithography, Nano-imprint and micro-fabrication.

8. The method as claimed in claim 1, wherein the reflection efficiency of the sub wavelength grating is above 80% for $O^{th}$ order reflections of longer wavelengths and above 30% for diffraction of shorter wavelengths.

9. The method as claimed in claim 1, wherein the sub wavelength grating is selected from the group consisting of rectangular, triangular, semi-circular profile projections and polygonal shapes.

10. The method as claimed in claim 1, wherein other security feature(s) is/are incorporated in the grating materials of the security thread to enhance contrast.

11. The method as claimed in claim 1 wherein the color reflection can be distinguished at any viewing angle of the observer.

12. The method as claimed in claim 1, wherein the security feature is a security thread.

13. The method as claimed in claim 12, wherein the security feature optionally shows a polarization effect.

14. The method as claimed in claim 1, wherein the substrate is selected from the group consisting of paper; a fibrous material; a plastic or polymeric material including but not limited to polypropylene (PP), polyethylene (PE), polycarbonate (PC), polyvinyl chloride (PVC), polyethylene terephthalate (PET); a composite material of two or more materials; and a composite material of two or more polymeric materials.

15. The method of claim 5, wherein the silicon derivative is amorphous silicon or porous silicon.

16. The method of claim 5, wherein the nitride is gallium nitride or aluminum nitride.

17. The method of claim 10, wherein the other security feature(s) is/are a fluorescent marker and/or a magnetic marker.

18. The method of claim 14, wherein the fibrous material is cellulose.

19. The method of claim 14, wherein the composite material of two or more materials is a laminate of paper and at least one plastic material.

* * * * *

UNITED STATES PATENT AND TRADEMARK OFFICE

CERTIFICATE OF CORRECTION

PATENT NO. : 9,221,293 B2
APPLICATION NO. : 14/062577
DATED : December 29, 2015
INVENTOR(S) : Pesala et al.

It is certified that error appears in the above-identified patent and that said Letters Patent is hereby corrected as shown below:

Title Page 1 (item 57, ABSTRACT) at line 7, Change "$O^{th}$ order" to --Zeroth order--.

In the Specification

In column 2 at line 1, Change "detector." to --detector,--.

In column 3 at line 51, Change "$O^{th}$ order" to --Zeroth order--.

In column 3 at line 56, Change "$0^{th}$ order" to --Zeroth order--.

In column 4 at line 6 (approx.), Change "birth." to --birth,--.

In column 4 at line 63, Change "substrate;" to --substrate.--.

In column 5 at line 28, Change "$0^{th}$ order" to --Zeroth order--.

In column 5 at line 43 (approx.), Change "$Si0_2$" to --$SiO_2$--.

In column 6 at line 2, After "transcript" insert --.--.

In column 6 at line 18 (approx.), After "angle" insert --.--.

In column 6 at line 20 (approx.), After "angles" insert --.--.

In column 6 at line 22 (approx.), After "angle" insert --.--.

In column 6 at line 24 (approx.), After "orders)" insert --.--.

In column 6 at line 26 (approx.), After "orders)" insert --.--.

In column 6 at line 28 (approx.), After "effect" insert --.--.

In column 6 at line 30 (approx.), After "effect" insert --.--.

In column 7 at line 40, Change "$O^{th}$ order" to --Zeroth order--.

In column 8 at line 27 (approx.), Change "card." to --card,--.

In column 8 at line 31 (approx.), After "transcript" insert --.--.

In column 8 at line 51 (approx.), After "0.5" insert --μm,--.

In column 8 at line 56 (approx.), Change "I." to --1.--.

In column 8 at line 59, Change "$O^{th}$ order" to --Zeroth order--.

Signed and Sealed this
Twenty-sixth Day of July, 2016

Michelle K. Lee

Michelle K. Lee
*Director of the United States Patent and Trademark Office*

In column 9 at line 14 (approx.), Change "$0^{th}$ order" to --Zeroth order--.

In column 9 at line 21 (approx.), Change "$O^{th}$ order" to --Zeroth order--.

In column 10 at line 36 (approx.), After "errors" insert --.--.

In the Claims

In column 10 at line 51, In Claim 1, after "0.3 μm" insert --to--.

In column 10 at line 56, In Claim 1, Change "$O^{th}$ order" to --Zeroth order--.

In column 11, at line 25, In Claim 8, Change "$O^{th}$ order" to --Zeroth order--.